US009176461B2

(12) United States Patent
Saito

(10) Patent No.: US 9,176,461 B2
(45) Date of Patent: Nov. 3, 2015

(54) IMAGE FORMING APPARATUS

(71) Applicant: Brother Kogyo Kabushiki Kaisha, Nagoya-shi, Aichi-ken (JP)

(72) Inventor: Toshiya Saito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/547,608

(22) Filed: Nov. 19, 2014

(65) Prior Publication Data

US 2015/0147085 A1 May 28, 2015

(30) Foreign Application Priority Data

Nov. 28, 2013 (JP) ..... 2013-245530

(51) Int. Cl.
*G03G 15/00* (2006.01)
*G03G 21/16* (2006.01)

(52) U.S. Cl.
CPC .... *G03G 21/1619* (2013.01); *G03G 2215/0132* (2013.01)

(58) Field of Classification Search
CPC ..... G03G 21/1633; G03G 21/1628
USPC ..... 399/125, 107
See application file for complete search history.

(56) References Cited

U.S. PATENT DOCUMENTS 7,484,722 B2 2/2009 Ishii
7,748,706 B2 7/2010 Ishii
7,995,948 B2 8/2011 Yano et al.
8,155,556 B2 4/2012 Moribe et al.
8,204,401 B2 6/2012 Tsuchiya
2006/0008294 A1 1/2006 Ito et al.
2006/0269320 A1 11/2006 Ishii
2007/0002290 A1* 1/2007 Muraki et al. ..... 353/119
2007/0036604 A1* 2/2007 Maekawa et al. ..... 400/615.2
2008/0049260 A1 2/2008 Moribe et al.

(Continued)

FOREIGN PATENT DOCUMENTS

JP H03-217861 A 9/1991
JP 2002-137493 A 5/2002

(Continued)

OTHER PUBLICATIONS

Apr. 10 2015—(US) Non-Final Office Action—U.S. Appl. No. 14/538,304.

(Continued)

*Primary Examiner* — Billy Lactaoen
(74) *Attorney, Agent, or Firm* — Banner & Witcoff, Ltd.

(57) ABSTRACT

An image forming apparatus, including a main body, a cover, and an upper unit, is provided. The cover includes a stackable surface to stack an ejected sheet and an attachment section extending upward from the stackable surface. The upper unit includes a base surface and an attachable section. The base surface spreads over the stackable surface with a predetermined amount of a gap reserved there-between. The attachable section is arranged in a position to adjoin the base surface to face a top surface of the attachment section and is attached to the attachment section. The attachment section has a downward dent on the top surface thereof. The downward dent adjoins a boundary part, which is a part of a gap formed in a position between the top surface and a bottom surface of the attachable section. The downward dent is a groove elongated in parallel with the boundary part.

18 Claims, 10 Drawing Sheets

(56) References Cited

U.S. PATENT DOCUMENTS

| | | | |
|---|---|---|---|
| 2009/0116889 | A1 | 5/2009 | Ishii |
| 2013/0272744 | A1 | 10/2013 | Wakayama et al. |

FOREIGN PATENT DOCUMENTS

| | | | |
|---|---|---|---|
| JP | 2002-182441 | A | 6/2002 |
| JP | 2002-351282 | A | 12/2002 |
| JP | 2005-018011 | A | 1/2005 |
| JP | 2006-053508 | A | 2/2006 |
| JP | 2006-337570 | A | 12/2006 |
| JP | 2007-062159 | A | 3/2007 |
| JP | 2007-292968 | A | 11/2007 |
| JP | 2008-052037 | A | 3/2008 |
| JP | 2009-169120 | A | 7/2009 |
| JP | 2009-169126 | A | 7/2009 |
| JP | 4826387 | B2 | 11/2011 |
| JP | 2012-203989 | A | 10/2012 |

OTHER PUBLICATIONS

Jun. 11, 2015—(US) Notice of Allowance—U.S. Appl. No. 14/525,608.

Jun 23, 2015—(US) Notice of Allowance—U.S. Appl. No. 14/553,116.

* cited by examiner

IMAGE FORMING APPARATUS

CROSS REFERENCE TO RELATED APPLICATION

This application claims priority from Japanese Patent Application No. 2013-245530 filed on Nov. 28, 2013, the entire subject matter of which is incorporated herein by reference.

BACKGROUND

1. Technical Field

An aspect of the present invention relates to an image forming apparatus.

2. Related Art

A conventionally known image forming apparatus may include an image forming unit, a main body, a cover of the main body, and an upper unit. The image forming unit may form an image on a sheet, the main body may accommodate the image forming unit, the cover may be placed over an upper part of the main body, and the upper unit may be disposed in an upper position with respect to the cover.

The cover may include a stackable surface and attachment sections on an upper side thereof. After an image is formed on a sheet in the image forming unit, the sheet may be ejected out of the main body through an ejection opening, which is formed on a rear side of the main body, and may be placed on the stackable surface. The attachment sections may be formed to laterally adjoin the stackable surface and extend upward with respect to the stackable surface. Meanwhile, the upper unit may provide a ceiling plane and attachable sections at a lower side thereof. The ceiling plane may spread over the stackable surface with a predetermined amount of gap being reserved in there-between. The attachable sections may be arranged to face top surfaces of the attachment sections at positions to laterally adjoin the ceiling plane and may be attached to the attachment sections of the main body. Further, the image forming apparatus may be formed to have a pickup area, which spreads between the rear side and a front side of the main body. The pickup area may be formed by inner walls of the attachment sections, which adjoin the stackable surface and rise upward from the stackable surface, the stackable surface, and the ceiling plane of the upper unit. A user may pick up the sheet with the image from a sheet stack placed on the stackable surface through the pickup area.

The image forming apparatus may further include boundary parts. The boundary parts may be a part of gaps formed between the top surfaces of the attachment sections and lower surfaces of the attachable sections in the upper unit. The gaps may be exposed to be visually recognizable when viewed at a specific angle, wherein the view is not interfered with by the attachment sections that adjoin the stackable surface.

Image forming apparatuses, including the above-mentioned conventional image forming apparatus, may occasionally be exposed to liquid, such as water, which may be poured over the upper side of the upper unit. In this regard, the liquid pouring over the upper unit may enter the main body through the gaps formed between the top surfaces of the attachment sections and the lower surfaces of the attachable sections and may flow to the interior of the main body. If the liquid reaches the image forming unit, the image forming unit may be damaged.

SUMMARY

The present invention is advantageous in that an image forming apparatus, in which the image forming unit in the main body may be restrained from being damaged by liquid, even when the image forming apparatus is exposed to the liquid, is provided.

According to an aspect of the present invention, an image forming apparatus, including a main body; a cover configured to cover an upper part of the main body; an upper unit arranged in an upper position with respect to the cover, is provided. The cover includes a stackable surface, on which the sheet having the image formed thereon by an image forming unit and being ejected out of the main body is placed, and an attachment section formed to extend upward from the stackable surface and have an inner wall surface, on an upper side thereof. The inner wall surface of the attachment section adjoins the stackable surface and rising upward from the stackable surface. The upper unit includes a base surface and an attachable section on a bottom plane thereof. The base surface is arranged to spread over the stackable surface with a predetermined amount of a gap reserved between the base surface and the stackable surface. The attachable section is arranged in a position to adjoin the base surface to face a top surface of the attachment section and is configured to be attached to the attachment section. The attachment section is formed to have a downward dent on the top surface thereof, the downward dent being positioned to adjoin a boundary part, which is a part of a gap formed in a position between the top surface of the attachment section and a bottom surface of the attachable section. The downward dent is a groove elongated in parallel with the boundary part.

BRIEF DESCRIPTION OF THE ACCOMPANYING DRAWINGS

DETAILED DESCRIPTION

Figure 1:
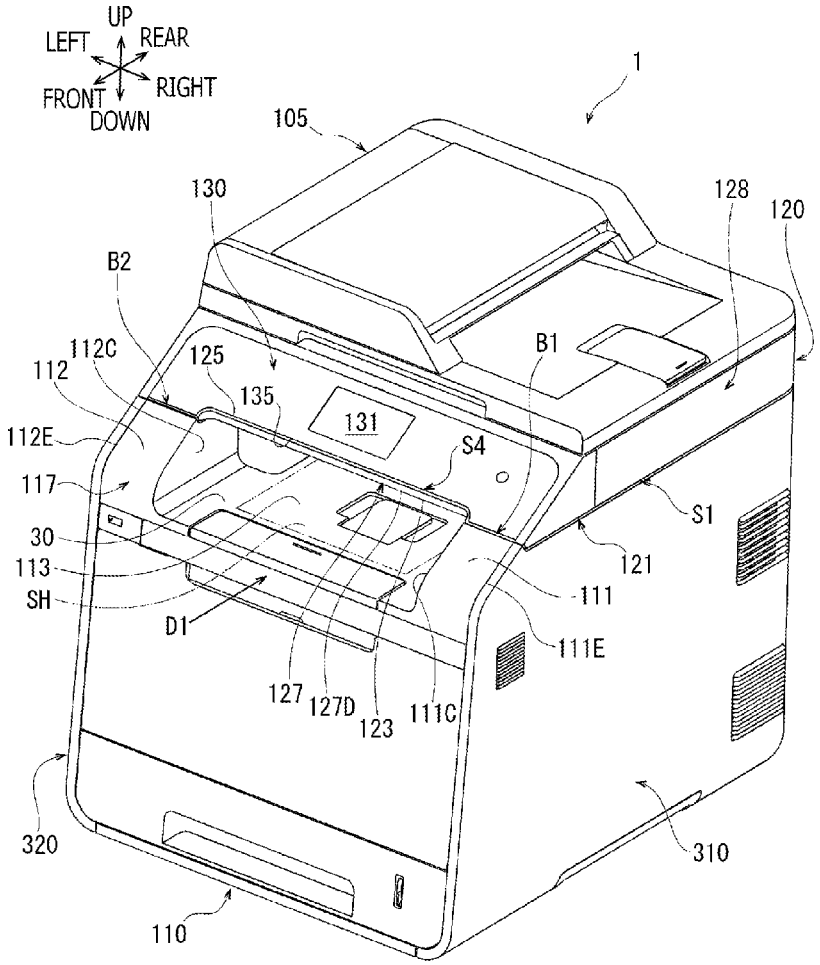
FIG. 1 is a perspective view of an image forming apparatus according to an embodiment of the present invention.

Hereinafter, a configuration of an image forming apparatus 1 according to an embodiment of the present invention will be described with reference to the accompanying drawings.

The image forming apparatus 1 is a multifunction peripheral device capable of processing a plurality of types of operations, which include, for example, an image forming operation and an image reading operation. In the following description, directions concerning the image forming apparatus 1 and parts included in the image forming apparatus 1 will be based on a user's ordinary usable posture to use the image forming apparatus 1 and referred to in accordance with orientation indicated by arrows in each drawing. Therefore, for example, a side, on which an operation panel 130 (see FIG. 1) is disposed, is defined as front, and a left-hand side for the user facing the front side of the image forming apparatus 1 is defined as left. A right-to-left or left-to-right direction of the image forming apparatus 1 may also be referred to as a right-left direction or a widthwise direction. An up-to-down or down-to-up direction corresponds to a vertical direction of the image forming apparatus 1. The front-to-rear or rear-to-front direction may be referred to as a front-rear direction or a direction of depth. Furthermore, directions of the drawings in FIGS. 2-16 are similarly based on the orientation of the image forming apparatus 1 as defined above and correspond to those with respect to the image forming apparatus 1 shown in FIG. 1 even when the image forming apparatus 1 in the drawings is viewed from different angles.

Overall Configuration of the Image Forming Apparatus

As shown in FIGS. 1-10, the image forming apparatus 1 includes a main body 110, a joint cover 117, exterior covers 310, 320, an upper unit 120, and an openable part 105.

Figure 2:
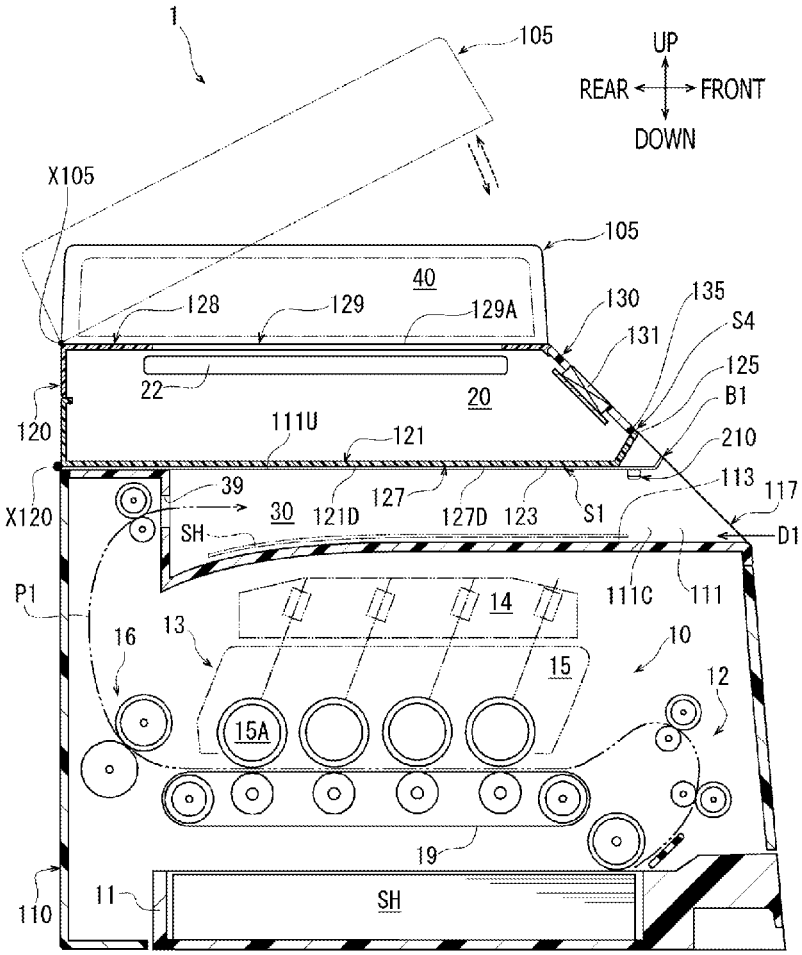
FIG. 2 is a cross-sectional view of the image forming apparatus according to the embodiment of the present invention.

The main body 110 is an assembly of a plurality of frame parts (not shown). As shown in FIG. 2, the main body 110 accommodates an image forming unit 10 to hold therein through some of the frame parts. The image forming unit 10 will be described later in detail.

Figure 4:
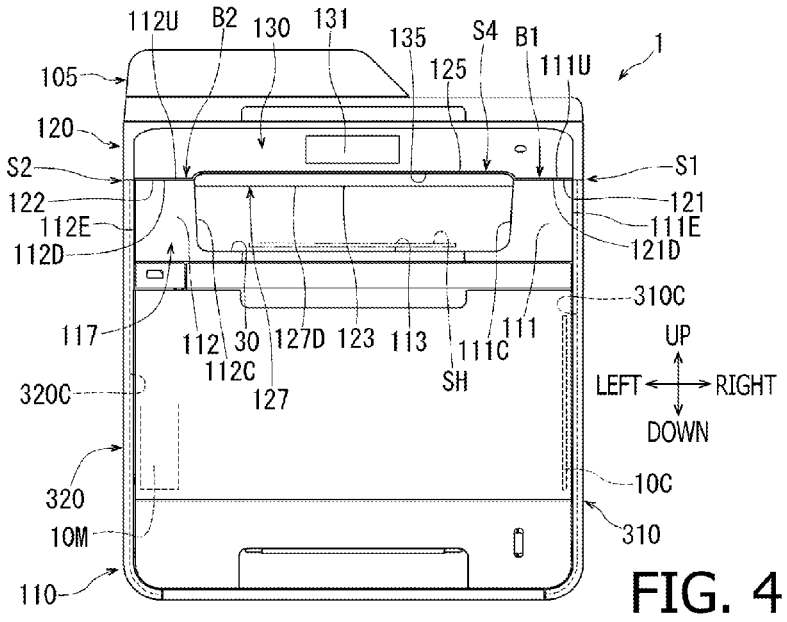
FIG. 4 is a front view of the image forming apparatus according to the embodiment of the present invention.

The joint cover 117 and the exterior covers 310, 320 are molded in resin. As shown in FIGS. 1 and 4, the joint cover 117 (see also FIG. 5) is attached to upper portions of the frame parts of the main body 110 and covers an upper part of the main body 110. As shown in FIGS. 1 and 4, the exterior cover 310 on the right is attached to a rightward portion of the frame parts forming the main body 110 and covers a right-hand side of the main body 110. The exterior cover 320 on the left is attached to a leftward portion of the frame parts forming the main body 110 and covers a right-hand side of the main body 110.

As shown in FIGS. 1-4, the upper unit 120 is arranged in an upper position with respect to the joint cover 117. The openable part 105 is arranged in an upper position with respect to the upper unit 120.

As shown in FIGS. 1-5, the upper unit 120 is formed to have a stackable surface 113 and a pair of attachment sections 111, 112 on an upper side thereof.

Figure 5:
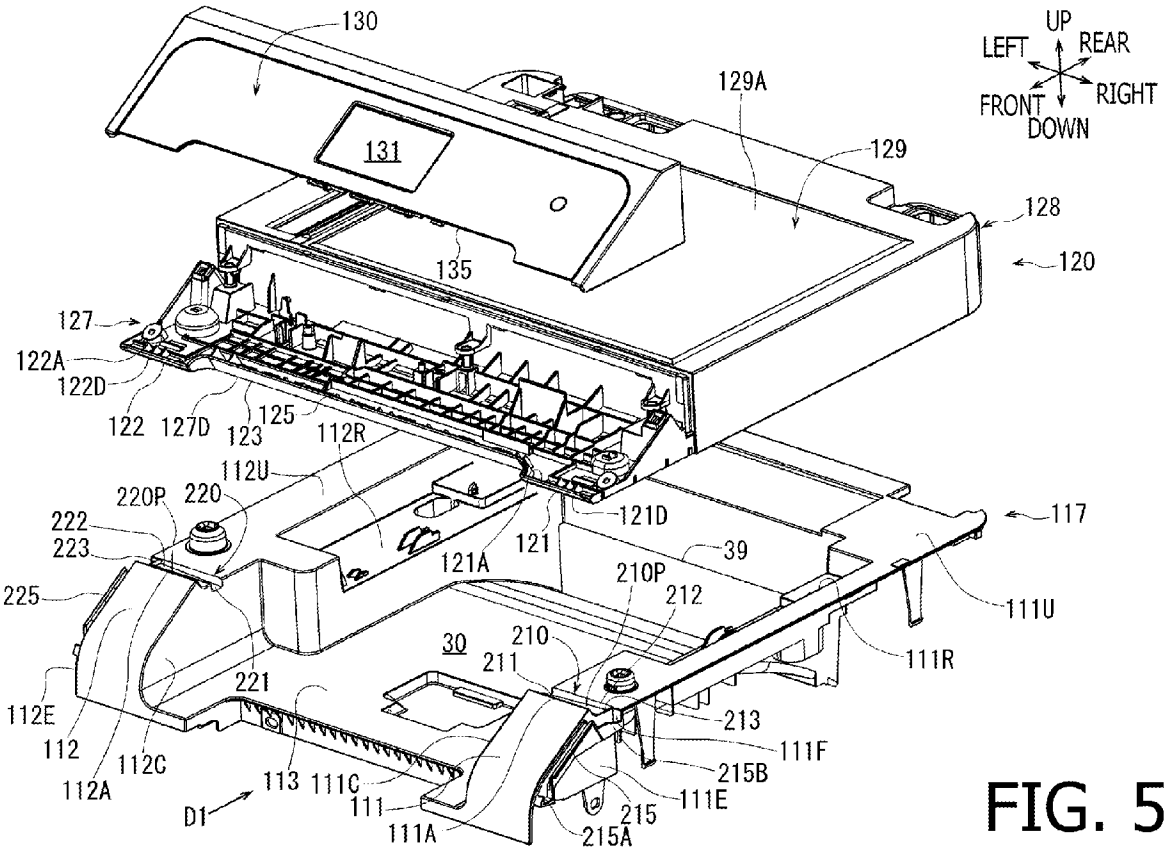
FIG. 5 is an exploded view of the image forming apparatus including a joint cover, a base cover, and an operation panel according to the embodiment of the present invention.

As shown in FIGS. 1, 2, 4, and 5, the stackable surface 113 is a flat surface spreading along the front-rear direction and the widthwise direction. More specifically, the stackable surface 113 horizontally spreads rearward from the front side of the main body 110 and inclines lower-rearward at a rear part thereof. As shown in FIGS. 2 and 5, the joint cover 117 is formed to have a wall rising substantially vertically at a rear end thereof, and an ejection opening 39 is formed on the rear wall. The ejection opening 39 is formed to penetrate the rear wall through the front-rear direction. The ejection opening 39 is formed in a rectangular shape elongated along the widthwise direction.

A direction for a sheet SH to be ejected through the ejection opening 39 is substantially in parallel with the front-rear direction and coincides with a frontward direction with respect to the ejection opening 39. A direction for a user who is on the front side of the image forming apparatus 1 to face the stackable surface 113, i.e., the front-to-rear direction, will be referred to as a specific direction D1 (see, for example, FIGS. 1 and 2). In other words, the specific direction D1 may be in parallel with the front-rear direction. Meanwhile, the widthwise direction, which coincides with the right-left direction, is orthogonal to the vertical direction and to the direction of ejecting the sheet SH. Sides at lateral ends along the widthwise direction may be referred to as a side of the exterior cover 310 and a side of the exterior cover 320.

As shown in FIGS. 4-9, the attachment section 111 on the right is arranged on the side of the exterior cover 310 to adjoin the stackable surface 113. On the other hand, the attachment section 112 on the left is arranged on the side of the exterior cover 320 to adjoin the stackable surface 113. The attachment sections 111, 112 extend upward from the stackable surface 113. At the same time, the attachment sections 111, 112 stretch along the front-rear direction between the front side and the rear side of the main body 110.

An inner wall surface 111C of the attachment section 111 on the right faces leftward at a rightward end of the stackable surface 113 and rises substantially vertically from the right-side edge of the stackable surface 113, which extends along the front-rear direction. An inner wall surface 112C of the attachment section 112 on the left faces rightward at a leftward end of the stackable surface 113 and rises substantially vertically from a left-side edge of the stackable surface 113, which extends along the front-rear direction.

Figure 6:
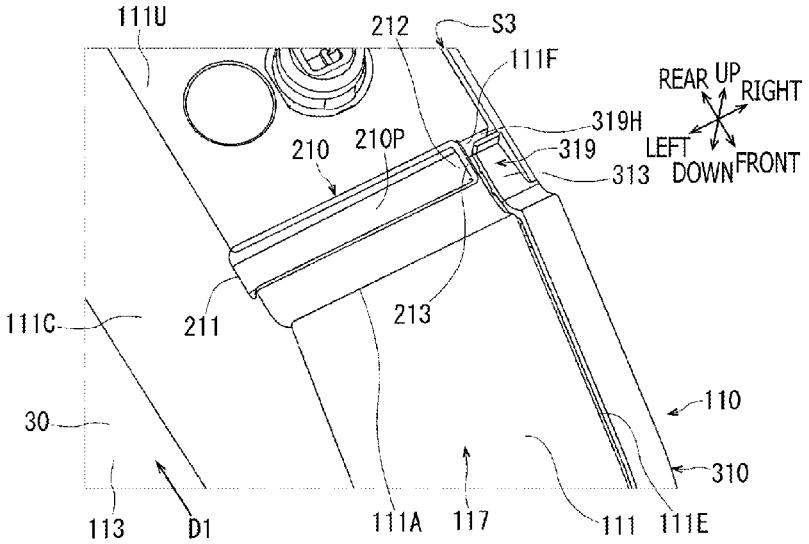
FIG. 6 is a perspective partial view of the image forming apparatus illustrating an area including an attachment section according to the embodiment of the present invention.
Figure 7:
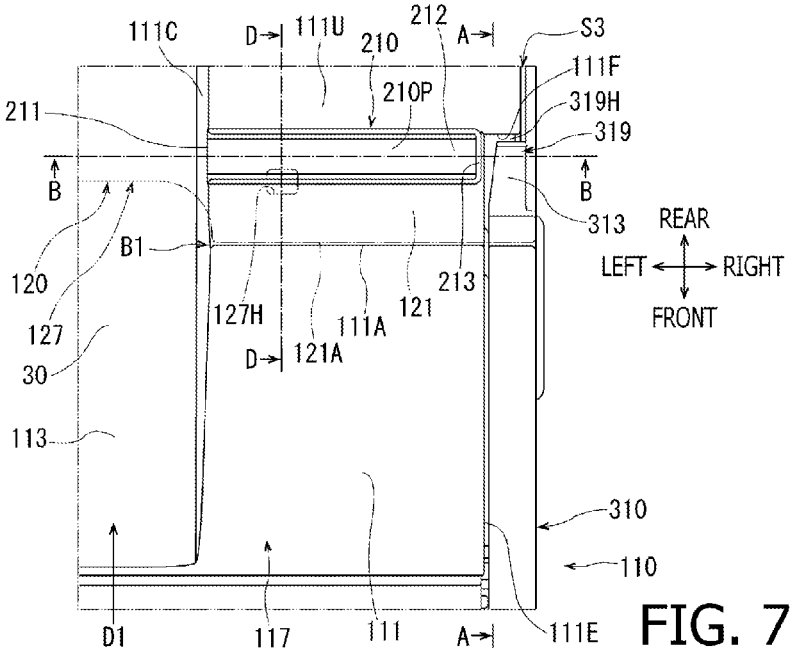
FIG. 7 is a top plain view of the image forming apparatus illustrating the area including the attachment section according to the embodiment of the present invention.
Figure 8:
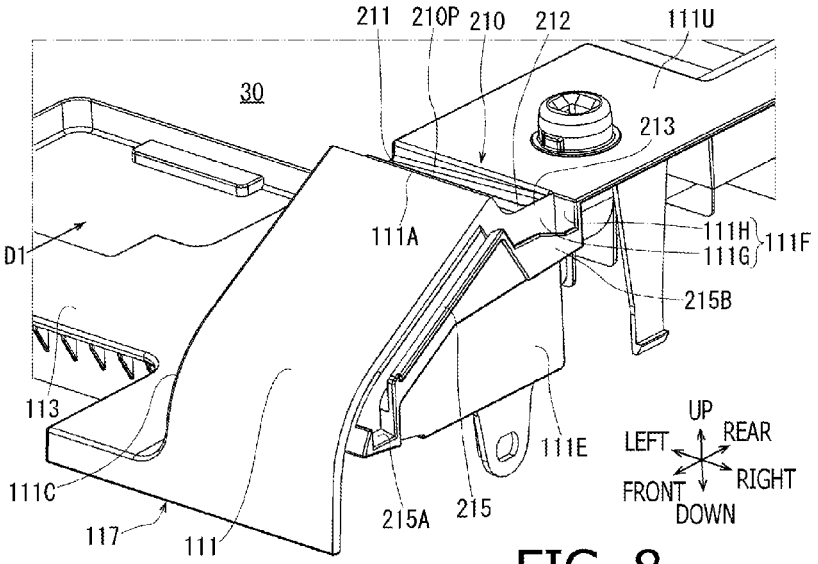
FIG. 8 is a perspective partial view of the image forming apparatus, illustrating a part of the cover including the attachment section, a groove, a first wall, and a first guide, according to the embodiment of the present invention.
Figure 9:
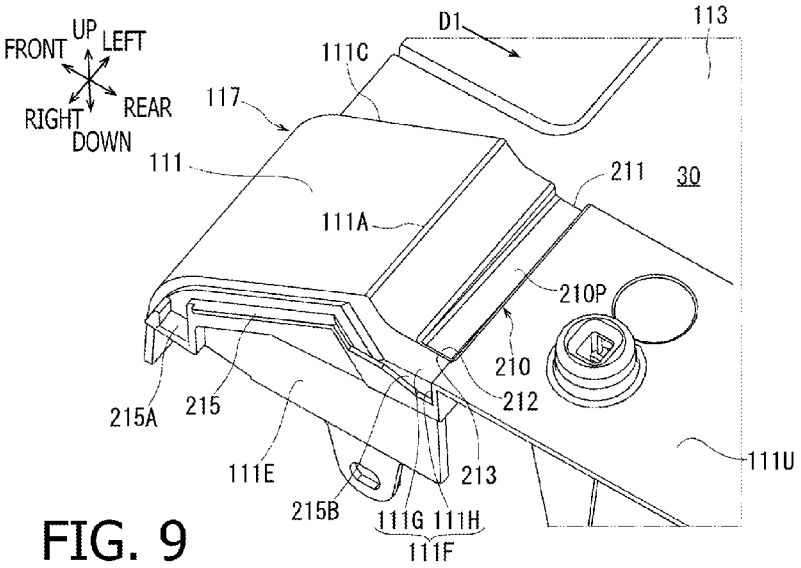
FIG. 9 is a perspective partial view of the image forming apparatus, illustrating a part of the cover including the attachment section, the groove, the first wall, and the first guide, according to the embodiment of the present invention.
Figure 10:
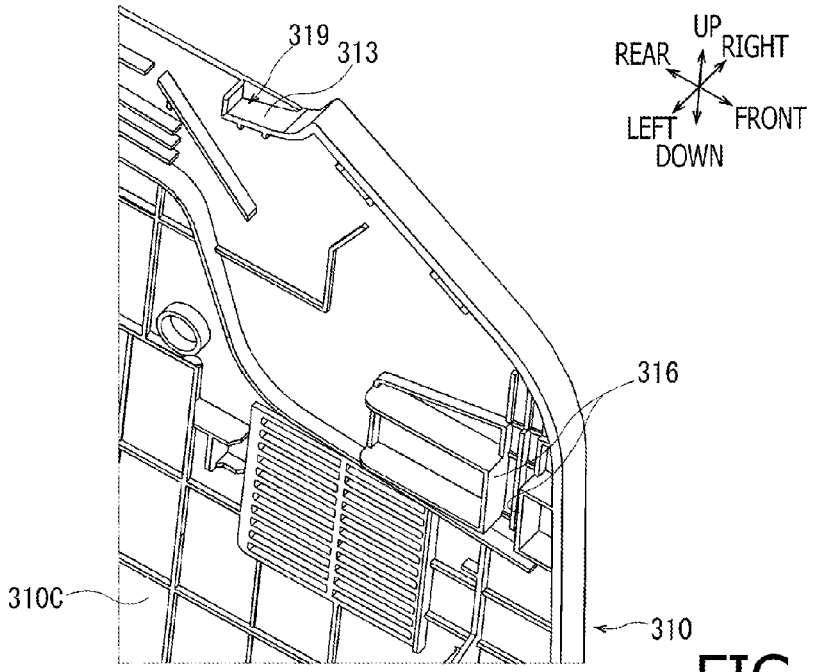
FIG. 10 is a perspective partial view of the image forming apparatus, illustrating a part of an exterior cover including a second wall and a second guide, according to the embodiment of the present invention.

As shown in FIG. 4, an outer wall surface 111E of the attachment section 111 on the right faces a direction opposite from the inner wall surface 111C, i.e., leftward. As shown in FIG. 5, the outer wall surface 111E is not formed to have a plain surface but is formed to have rather complex asperity with projections and recesses. Meanwhile, as shown in FIG. 10, an inner surface 310C of the exterior cover 310 on the right is formed to have a substantially flat surface except for a plurality of gridded ribs. As shown in FIGS. 1, 4, and 6-13, the exterior cover 310 on the right covers the outer wall surface 111E of the attachment section 111 on the right. As shown in FIGS. 6 and 7, a gap S3 is formed in a position between the outer wall surface 111E of the attachment section 111 on the right and an upper edge of the exterior cover 310 on the right.

The gap S3 forms a shape elongated along a right-side edge of an upper surface 111U of the attachment section 111 along the front-rear direction.

As shown in FIG. 4, an outer wall surface 112E of the attachment section 112 on the left faces a direction opposite from the inner wall surface 112C, i.e., rightward. Although not shown in the drawings, the outer wall surface 112E of the attachment section 112 on the left is not formed to have a plain surface but is formed to have rather complex asperity with projections and recesses, similarly to the outer wall surface 111E of the attachment section 111 on the right. Meanwhile, although not shown in the drawings, an inner surface 320C of the exterior cover 320 on the left is formed to have a substantially flat surface except for a plurality of gridded ribs, similarly to the inner surface 310C of the exterior cover 310 on the right. As shown in FIG. 4, the exterior cover 320 on the left covers the outer wall surface 112E of the attachment section 112 on the left. Although not shown in the drawings, a gap similarly to the gap S3 is formed in a position between the outer wall surface 112E of the attachment section 112 on the left and an upper edge of the exterior cover 320 on the left.

Figure 3:
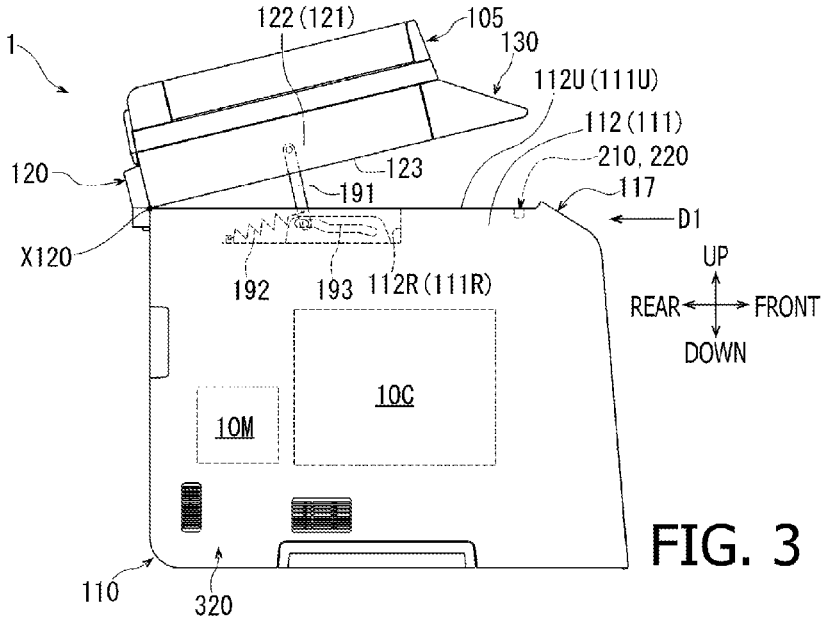
FIG. 3 is a lateral view of the image forming apparatus according to the embodiment of the present invention.

As shown in FIGS. 3 and 5, the attachment sections 111, 112 are formed to have link housings 111R, 112R on the upper surfaces 111U, 112U thereof respectively. The link housings 111R, 112R are formed to dent downward with respect to the upper surfaces 111U, 112U of the attachment sections 111, 112. As shown in FIG. 3, each of the link housings 111R, 112R accommodates a link rod 191, a coil spring 192, and a guide rail 193. A lower end of the link rod 19 is engaged with the guide rail 193 and is urged rearward by the coil spring 192.

As shown in FIG. 5, the upper unit 120 includes a top cover 128, a platen glass 129, a base cover 127, and the operation panel 130.

As shown in FIGS. 2, 4, 5, and 12-16, the base cover 127 includes a bottom block 127D. The bottom block 127D is formed to spread substantially flat along the front-rear direction and the widthwise direction. The base cover 127 is coupled with the top cover 128 and covers an interior of the upper unit 120 with the bottom block 127D from below. The bottom block 127D thus forms a bottom of the upper unit 120.

As shown in FIGS. 2 and 5, the top cover 128 is in a form of a frame. The platen glass 129 is arranged at a top of the upper unit 120 between the top cover 128 and the base cover 127 and is exposed through the top cover 128. An upper surface of the platen glass 129 serves as a supporting surface 129A.

As shown in FIGS. 1-5, the base cover 127 includes a base surface 123 and a pair of attachable sections 121, 122. The base surface 123 is a part of the bottom block 127D arranged to cover the stackable surface 113 from above with a predetermined amount of gap reserved there-between. The attachable section 121 on the right is a part of the bottom block 127D adjoining the base surface 123 from the right. The attachable section 122 on the left is a part of the bottom block 127D adjoining the base surface 123 from the left.

In the present embodiment, a configuration including the attachment section 111 on the right, the attachable section 121 on the right, and other peripheral parts on the right and a configuration including the attachment section 112 on the left, the attachable section 122 on the left, and other peripheral parts on the left are substantially identical to one another except the rightward/leftward orientation thereof and function identically. Therefore, in the following description, the attachment section 111 and the attachable section 121 on the right will represent the attachment sections 111, 112 and the attachable sections 121, 122 respectively, and description of the other ones on the left may be omitted.

As shown in FIGS. 2, 4, 12 and 16, the attachable section 121 on the right is arranged to face and attached to the upper surface 111U of the attachment section 111 on the right. Meanwhile, as shown in FIG. 4, the attachable section 122 on the left is arranged to face and attached to the upper surface 112U of the attachment section 112 on the left.

As shown in FIG. 3, the upper unit 120 is rotatably supported at a lower edge thereof by a rear edge of the main body 110 through a pair of hinges, which are not shown, to rotate about a rotation axis X120. When the upper unit 120 is in a closed position, as shown in FIGS. 1, 2, and 4, the base surface 123 of the upper unit 120 is arranged at a position spaced apart from the stackable surface 113 for the predetermined amount of gap and covers the stackable surface 113 from above. On the other hand, when the upper unit 120 is in an open position, as shown in FIG. 3, the base surface 123 of the upper unit 120 is further spaced apart upward from the stackable surface 113 for an amount larger than the predetermined amount of the gap.

As shown in FIG. 3, upper ends of the link rods 191 are coupled to the attachable section 121, 122 of the upper unit 120 respectively. When the upper unit 120 is in the open position (FIG. 3), the link rods 191 are maintained in an upright posture and prevent the upper unit 120 from falling down against gravity.

Figure 12:
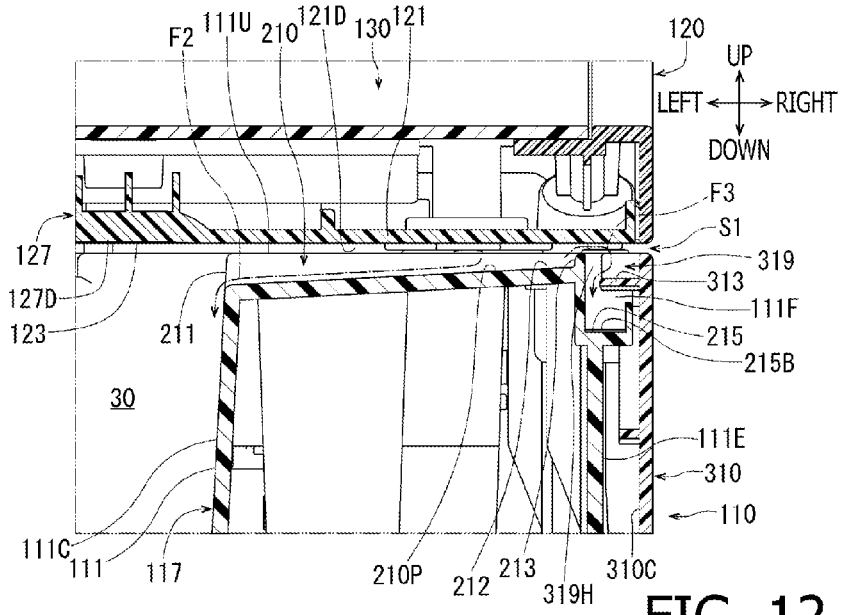
FIG. 12 is a cross-sectional partial view of the image forming apparatus according to the embodiment of the present invention taken along a line B-B shown in FIG. 7.
Figure 16:
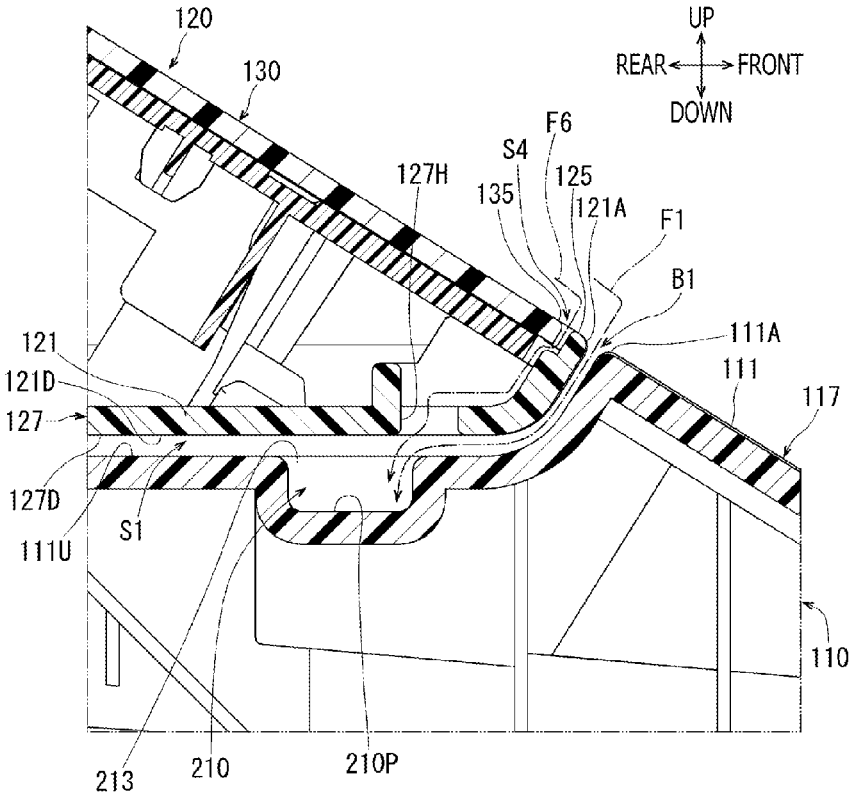
FIG. 16 is a cross-sectional partial view of the image forming apparatus according to the embodiment of the present invention taken along a line D-D shown in FIG. 7.

When the upper unit 120 is in the closed position (see FIGS. 1, 2, and 4), a gap S1 is formed between the upper surface 111U of the attachment section 111 on the right and a lower surface 121D of the attachable section 121 on the right. As shown in FIGS. 12 and 16, the gap S1 is formed in a range, in which the upper surface 111U and the lower surface 121D vertically coincide with each other, entirely. Meanwhile, as shown in FIG. 4, a gap S2 is formed between the upper surface 112U of the attachment section 112 on the left and a lower surface 122D of the attachable section 122 on the left. The gap S2 is formed in a range, in which the upper surface 112U and the lower surface 122D vertically coincide with each other, entirely.

As shown in FIGS. 1 and 4, the image forming apparatus 1 includes boundary parts B1, B2. The boundary part B1 on the right is formed between a front edge 111A (see FIGS. 5-9, 14, and 16) of the upper surface 111U of the attachment section 111 and a front edge 121A (see FIGS. 5, 7, and 14-16) of the lower surface 121D of the attachable section 121. The boundary part B1 ranges longitudinally along the widthwise direction. The boundary part B2 on the left is formed between a front edge 112A (see FIG. 5) of the upper surface 112U of the attachment section 111 and a front edge 122A (see FIG. 5) of the lower surface 122D of the attachable section 122. The boundary part B2 ranges longitudinally along the widthwise direction. In other words, the boundary part B1 on the right is a part of the gap S1 and is exposed to be visually recognizable when viewed along the specific direction D1. The boundary part B2 on the left is a part of the gap S2 and is exposed to be visually recognizable when viewed along the specific direction D1.

As shown in FIGS. 1, 2, and 4, the image forming apparatus 1 is formed to have a pickup area 30. The pickup area 30 is a space surrounded by the inner wall surfaces 111C, 112C of the attachment sections 111, 112 adjoining and rising from the stackable surface 113, the stackable surface 113, and the base surface 123. The pickup area 30 is in a shape of a front-open five-sided flat box, which is sided by the attachment sections 111, 112, the stackable surface 113, and the base surface 123 forming a ceiling of the pickup area 30, expanding along the front-rear direction and the widthwise direction. The pickup area 30 is open frontward through front ends of the main body 110 and the upper unit 120.

As shown in FIGS. 1 and 5, the operation panel 130 is arranged in a frontward position with respect to the platen glass 129 and is attached to the top cover 128 and the base cover 127. The operation panel 130 is arranged on an upper side of the bottom block 127D, in a part of the bottom block 127D protruding frontward with respect to the top cover 128.

As shown in, for example, FIGS. 5 and 16, a lower edge 135 of the operation panel 130 adjoins a front edge 125 of the bottom block 127D of the base cover 127 from an upper side. In this regard, as shown in FIG. 16, a gap S4 is formed between the lower edge 135 of the operation panel 130 and the front edge 125 of the bottom block 127D. The operation panel 130 includes an inclined surface, which inclines to be lower at the front at the lower end 135 and higher at the rear as approaching the platen glass 129. The operation panel 130 is disposed in a position spaced apart farther from the attachment sections 111, 112 with respect to the boundary parts B1, B2 and forms a part of an upper plane of the upper unit 120.

As shown in, for example, FIG. 1, the operation panel 130 includes a touch-sensitive panel 131. The touch-sensitive panel 130 is housed in the upper unit 120 at a central position in the operation panel 130 and is exposed outwardly from the operation panel 130. Through the touch-sensitive panel 131, the operation panel 130 displays information concerning, for example, a condition and settings of the image forming apparatus 1, and receives input from the user.

As shown in FIG. 2, the openable part 105 is rotatably supported at a lower edge of a rear face thereof by an upper edge of a rear face of the upper unit 120 through a pair of hinges, which are not shown, to rotate about a rotation axis X105. The openable part 105 is, when in a closed position as indicated by a solid line in FIG. 2, arranged to cover a supporting surface 129A which is provided on an upper plane of the upper unit 120. The openable part 105 rotates about the rotation axis X105 when a front end thereof is uplifted and is placed in an inclined position, as indicated by a dash-and-double-dot line in FIG. 2, to expose the supporting plane 129A.

As shown in FIG. 2, the image forming apparatus 1 includes the image forming unit 10, a reader unit 20, and an auto-document conveyer 40.

The image forming unit 10 is accommodated in the main body 110. The image forming unit 10 includes a feeder cassette 11, a conveyer unit 12, and an image forming section 13.

The feeder cassette 11 is arranged at a bottom of the main casing 110. The feeder cassette 11 stores the sheets SH therein. The conveyer unit 12 picks up the sheets SH from the feeder cassette 11 one by one, conveys along a conveyer path P1, which is formed in an approximate shape of an S, and ejects the sheets SH from the main body 110 through the ejection opening 39 to the stackable surface 113. A direction to eject the sheets SH from the main body 110 through the ejection opening 39 is substantially in parallel with the specific direction D1, i.e., the front-rear direction. The image forming section 13 is arranged in an upper position with respect to the feeder cassette 11 and in a lower position with respect to the stackable surface 113. The sheets SH being conveyed by the conveyer unit 12 pass by the image forming section 13 at a flat part in the conveyer path P1, and images are formed on the sheets SH by the image forming section 13 as the sheets SH pass through the flat part in the conveyer path P1.

The image forming section 13 is a so-called direct tandem-typed image forming unit, which is capable of forming images in colors. The image forming section 13 includes a developer toner cartridge 15, a transfer belt 19, a scanner unit 14, and a fixing unit 16.

The developer toner cartridge 15 is an assembly of four (4) cartridges, which correspond to colors of black, yellow, magenta, and cyan respectively and align in line along the flat part of the conveyer path P1. The developer cartridge 15 includes photosensitive drums 15A, developer rollers (not shown), chargers (not shown), and toner containers (not shown). The transfer belt 19 is arranged in a lower position with respect to the photosensitive drums 15A across the flat part of the conveyer path P1. The transfer belt 19 nips the sheet SH being conveyed in conjunction with the photosensitive drums 15A and circulates. The scanner unit 14 includes laser light sources, polygon mirrors, fθ lenses, and mirrors, which are not shown. The scanner unit 14 emits laser beams downwardly at the photosensitive drums 15A in the developer toner cartridges 15. The fixing unit 16 nips the sheet SH, which has passed by the developer toner cartridges 15, by a heat roller and a pressure (not shown) to apply heat and pressure to the sheet SH.

The image forming unit 10 includes electric devices, including a control board 10C and a driving motor 10M (see FIGS. 3 and 4).

The control board 10C is arranged in the main body 110 in a position to adjoin the inner surface 310C of the exterior cover 310 on the right. The control board 10C is a flat board arranged to spread in the vertical direction and the widthwise direction along the inner surface 310C. The control board 10C controls the image forming unit 10 to conduct an image forming operation by manipulating the conveyer unit 12 and the image forming section 13. The control board 10C further controls the image forming operation by manipulating the reader unit 20 and the auto-document conveyer 40.

The driving motor 10M is arranged in the main body 110 in a position to adjoin the inner surface 320C of the exterior cover 320 on the left. The driving motor 10M is controlled by the control board 10C and drives the conveyer unit 12 and the image forming section 13.

The image forming section 13 configured as above forms an image on the sheet SH in the following procedure: that is, as the photosensitive drums 15A rotate, surfaces of the photosensitive drums 15A are positively charged evenly and exposed to the scanning laser beams emitted from the scanner unit 14 (see FIG. 2). Thereby, latent images corresponding to the images to be formed on the sheet SH are formed on the surfaces of the photosensitive drums 15A. Thereafter, the toner from the toner containers is supplied to the latent images formed on the surfaces of the photosensitive drums 15A, and the toner carried on the surfaces of the photosensitive drums 15A are transferred to the sheet SH. The sheet SH with the transferred images are heated and pressed in the fixing unit 16, and the toner is fixed at the sheet SH.

The sheets SH with the images formed thereon are ejected outside the main body 110 through the ejection opening 39 and stacked on the stackable surface 113. The user may insert a hand from the front side of the image forming apparatus 1 in the pickup area 30 to access and pick up the sheets SH stacked on the stackable surface 113. In this regard, the user may pick up the sheets SH along the specific direction D1, along which the attachment sections 111, 112 and the stackable surface 111 do not adjoin each other. In other words, when the user access the sheets SH stacked on the stackable surface 113 along the specific direction D1, the attachment sections 111, 112 do not interfere with the user. The specific direction D1 shown in, for example, FIG. 1 is an example of the direction along the ejecting direction to eject the sheets SH from the main body 110. In this regard, even if the specific direction D1 inclines with respect to the ejecting direction of the sheets SH, as long as the user can access the pickup area 30 along the inclined direction, the inclined direction should fall within the scope of the specific direction D1.

Meanwhile, the image forming unit 10 may not necessarily form the images in the laser-printing method but may form the images in other methods such as an inkjet-printing method.

The reader unit 20 is accommodated in the upper unit 120. The reader unit 20 is a so-called flatbed reader. An original document to be read is placed on the supporting plane 129A, which is provided on the upper plane of the upper unit 120.

In a lower position with respect to the platen glass 129, a reader sensor 22 is arranged. The reader sensor 22 is a known image reading sensor, which may include, for example, a contact image sensor (CIS) and a charge coupled device (CCD). The reader sensor 22 is movable to reciprocate along a lower surface of the platen glass 129 in the widthwise direction, e.g., a direction orthogonal to a plane of FIG. 2.

With the reader unit 20 configured as above, while the openable part 105 is uplifted to expose the supporting plane 129A, the original document may be placed on the supporting plane 129A. With the original document placed on the supporting plane 129A, the reader sensor 22 reads divided parts of the image appearing on the original document line by line sequentially along a main scanning direction, e.g., the front-rear direction, while the reader sensor 22 is moved along an auxiliary scanning direction, e.g., the widthwise direction. Thus, the reader unit 20 reads the image appearing on the original document entirely.

The auto-document conveyer 40 is accommodated in the openable part 105. The auto-document conveyer 40 conveys a plurality of sheets of original document one by one and manipulates the sheets of original document to pass over the reader sensor 22, which is located at a predetermined fixed reading position. The reader unit 20 thus reads the images appearing on the plurality of sheets of original document by the reader sensor 22.

Detailed Configuration of Grooves, First and Second Walls, Apertures, First and Second Guides, and Ports While there may be a risk that liquid may be poured over the operation panel 130 of the upper unit 120, in the image forming apparatus 1 according to the present embodiment, grooves 210, 220 (see FIGS. 5-16) are provided in order to avoid or restrain the liquid from entering the main body 110 through the boundary parts B1, B2 and gaps S1, S2.

In the present embodiment, a configuration including the groove 210 on the right and other peripheral parts on the right and a configuration including the groove 220 on the left and other peripheral parts on the left are substantially identical to one another except the rightward/leftward orientation thereof and function identically. Therefore, in the following description, the groove 210 on the right will represent the grooves 210, 220, and description of the other one on the left may be omitted.

As shown in FIGS. 5-9, 12 and 16, the groove 210 is formed on the upper surface 111U of the attachment section 111 on the right. The groove 210 is formed in a rearward position with respect to the front edge 111A of the upper surface 111U. The groove 210 is formed to dent downward and has a three-sided top-open shape in a cross-sectional view. The groove 210 is elongated in parallel with the front edge 111A along the widthwise direction. In other words, the groove 210 is formed on the upper surface 111U in a position to adjoin the boundary part B1 and is elongated in parallel with the widthwise direction, along which the boundary part B1 extends.

As shown in FIG. 5, the groove 220 is formed on the upper surface 112U of the attachment section 111 on the left. The groove 220 is formed in a rearward position with respect to the front edge 112A of the upper surface 112U. The groove 220 is formed to dent downward and has a three-sided top-open shape in a cross-sectional view. The groove 220 is elongated in parallel with the front edge 112A along the widthwise direction. In other words, the groove 220 is formed on the upper surface 112U in a position to adjoin the boundary part B2 and is elongated in parallel with the widthwise direction, along which the boundary part B2 extends.

The control board 10C (see FIG. 3) is arranged in a rearward position with respect to the groove 210 on the right. Therefore, the control board 10C is arranged on a side opposite from the boundary part B1 on the right across the groove 210 on the right along the specific direction D1. The driving motor 10M (see FIG. 3) is arranged in a rearward position with respect to the groove 220 on the left. In other words, the driving motor 10M is arranged on a side opposite from the boundary part B2 on the left across the groove 220 on the left along the specific direction D1.

As shown in FIGS. 6 and 12, the groove 210 on the right is formed to have a bottom 210P, which inclines downward toward the pickup area 30, i.e., to be higher on the right side and lower on the left side. The groove 210 is in communication with the pickup area 30 through a first end 211 thereof, which is on a side of the pickup area 30. At a second end 212 of the groove 210, which is on a side of the outer wall surface 111E, a first wall 213 is formed. The first wall 213 rises upward from the second end 212 to a height, which is substantially at a same level as the upper surface 111U. The first wall 213 blockades a gap between the upper edge of the exterior cover 310 and the second end 212 of the groove 210.

As shown in FIG. 5, the groove 220 on the left is formed to have a bottom 220P, which inclines downward toward the pickup area 30, i.e., to be higher on the left side and lower on the right side. The groove 220 is in communication with the pickup area 30 through a first end 221 thereof, which is on a side of the pickup area 30. At a second end 222 of the groove 220, which is on a side of the outer wall surface 111E, a first wall 223 is formed. The first wall 223 rises upward from the second end 222 to a height, which is substantially at the same level as the upper surface 111U. The first wall 223 blockades a gap between the upper edge of the exterior cover 320 and the second end 222 of the groove 220.

As shown in FIGS. 6, 7, and 10-12, the exterior cover 310 on the right is formed to have an aperture-peripheral part 319. Meanwhile, the outer wall surface 111E is formed to have a dent 111F in a position opposite from the groove 210 across the first wall 213. As shown in FIGS. 8 and 9, the dent 111F includes a first plane 111G and a second plane 111H. The first plane 111G forms a rightward face of the first wall 213 which stretches frontward and downward. While a rear end of the first plane 111G extends vertically, the second plane 111H stretches from the rear end of the first plane 111G substantially orthogonally rightward. An upper end of the second plane 111H is connected substantially orthogonally to a rightward portion of the upper surface 112U with respect to the first wall 213. As shown in FIGS. 6, 7, and 10-12, the aperture-peripheral part 319 protrudes leftward from the upper end of the exterior cover 310 toward the dent 111F. In other words, the aperture-peripheral part 319 adjoins the second end 212 of the groove 210 on the right.

The aperture-peripheral part 319 stretches straight downward from the upper end of the exterior cover 310 and is bent to incline upper-frontward. The portion of the aperture-peripheral part 319 inclining upper-frontward forms a second wall 313. In other words, the second wall 313 is arranged in the exterior cover 310 on the right and forms a part of the aperture-peripheral part 319.

The aperture-peripheral part 319 is arranged to be spaced apart from the dent 111F along the front-rear direction and the widthwise direction to form a gap. In other words, in a position between the aperture-peripheral part 319 and the dent 111F of the outer wall surface 111E, an aperture 319H penetrating vertically is formed. As shown in FIG. 7, in a plane view viewed at a downward angle, the aperture 319H forms an approximate shape of an "L."

As shown in FIGS. 5, 8, 9, and 11-13, a first guide 215 is a guiding groove formed on the outer wall surface 111E of the attachment section 111, in a lower position with respect to the upper surface 111U of the attachment section 111 on the right. A first end portion 215B of the first guide 215 is formed in a lower position with respect to the dent 111F of the outer wall surface 111E. Therefore, the first end portion 215B is in a lower position with respect to the aperture 319H. The first guide 215 is formed to extend from the end portion 215B frontward toward the boundary part B1 and extend further to incline lower-frontward to a second end portion 215A, which is formed in a position approximate to the front face of the main body 110. In other words, while the first guide 215 longitudinally extends along the specific direction D1, the first guide 215 inclines with respect to the specific direction D1 with regard to the vertical direction to be lower as the first guide 215 extends frontward farther from the ejection opening 39.

The second wall 313 is formed in a lower position with respect to the aperture 319H and in an upper position with respect to the first end portion 215B of the first guide 215. The second wall 313 is formed to protrude from the inner surface 310C of the exterior cover 310 toward the dent 111F in the outer wall surface 111E.

Figure 11:
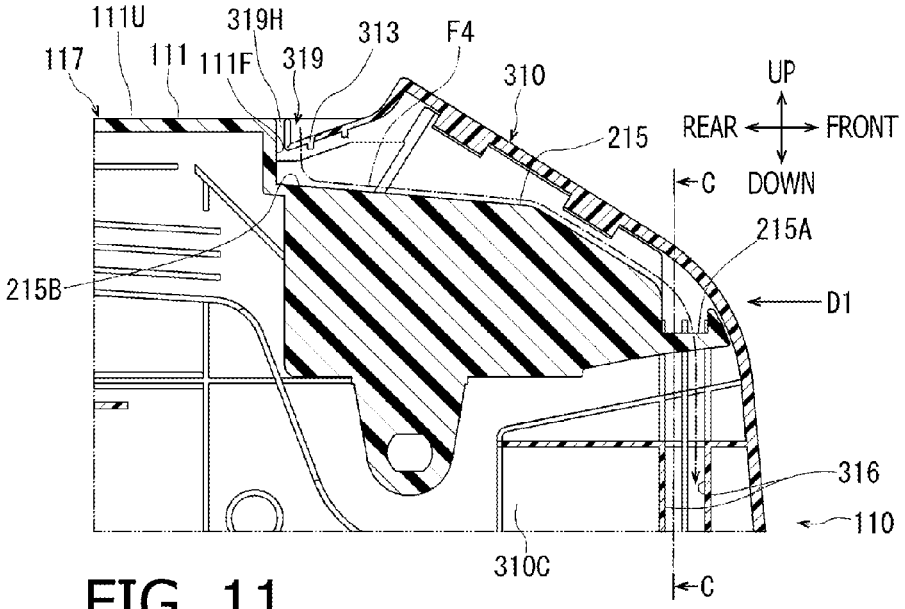
FIG. 11 is a cross-sectional partial view of the image forming apparatus according to the embodiment of the present invention taken along a line A-A shown in FIG. 7.
Figure 13:
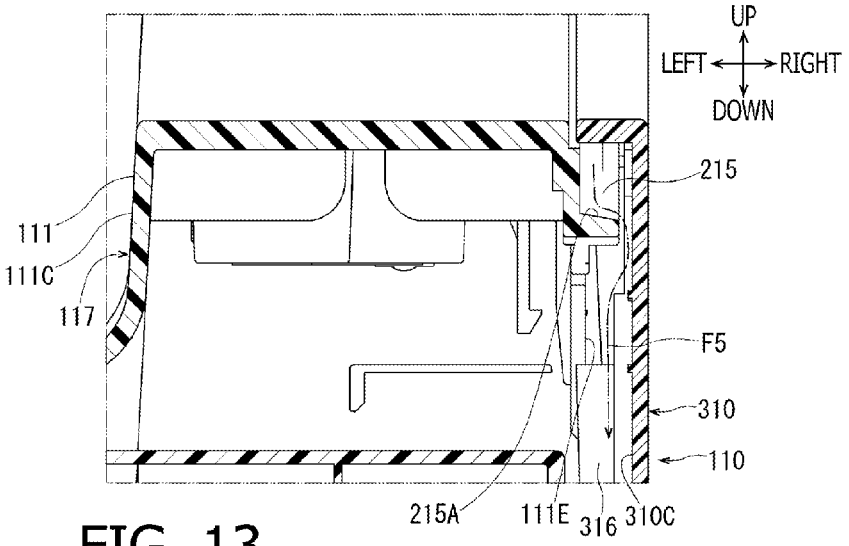
FIG. 13 is a cross-sectional partial view of the image forming apparatus according to the embodiment of the present invention taken along a line C-C shown in FIG. 11.
Figure 14:
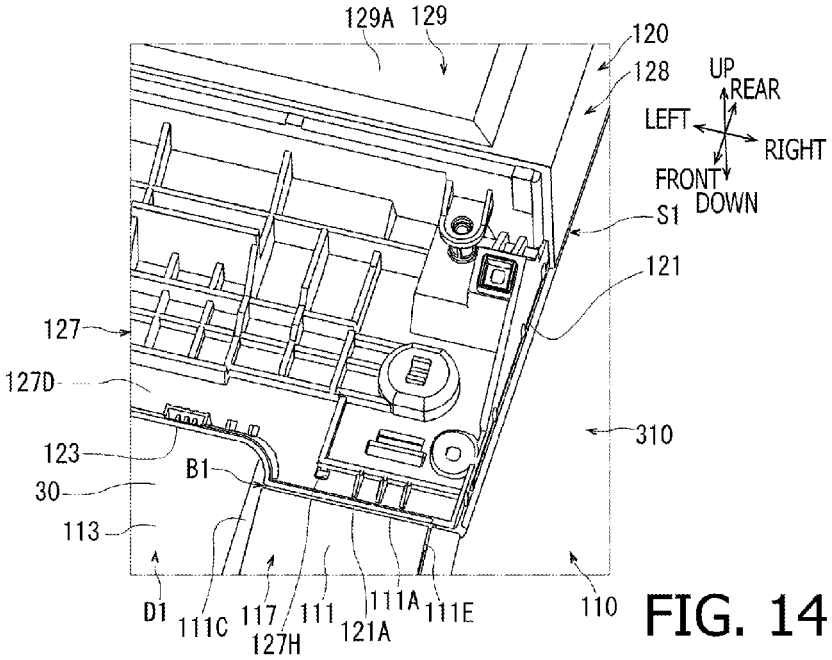
FIG. 14 is a perspective partial view of the image forming apparatus, illustrating an area including a bottom block and ports viewed at a downward angle, according to the embodiment of the present invention.
Figure 15:
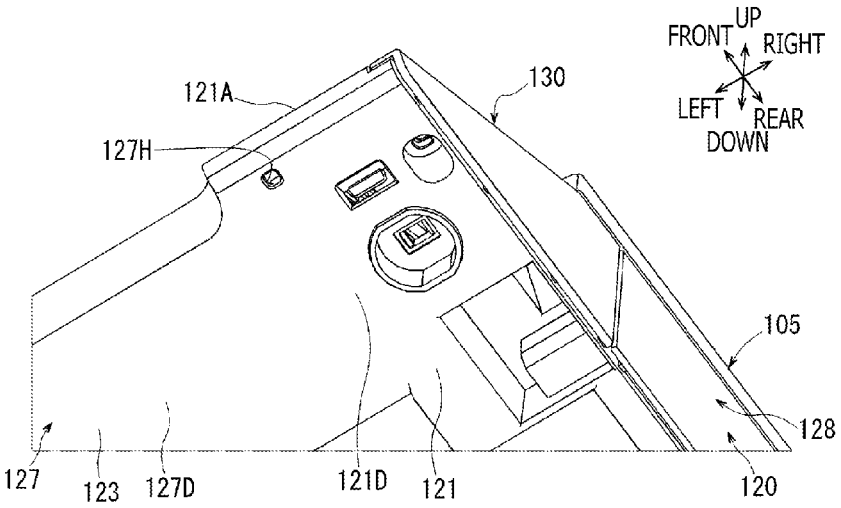
FIG. 15 is a perspective partial view of the image forming apparatus, illustrating the area including the bottom block and the ports viewed at an upward angle, according to the embodiment of the present invention.

As shown in FIGS. 10, 11, and 13, a second guide 316 is a guiding groove formed on the inner surface 310C of the exterior cover 310. The second guide 316 is formed in a lower position with respect to the second end portion 215A of the first guide 215. The second guide 316 is configured with surfaces of paired ribs elongated downward and spaced apart to face each other along the front-rear direction.

Although not shown in the drawings, the exterior cover 320 on the left is formed to have an aperture-peripheral part, which is similar to the aperture-peripheral part 319 in the exterior cover 310 on the right. The aperture-peripheral part is arranged to be spaced apart from the outer surface 112E to form a vertically penetrating aperture, which is similarly to the aperture 319. The aperture-peripheral part includes a second wall, which is similar to the second wall 313. As shown in FIG. 5, a first guide 225 is a guiding groove formed on the outer wall surface 112E of the attachment section 112, in a lower position with respect to the upper surface 112U of the attachment section 112 on the left. Although not shown in the drawings, similarly to the first guide 215, a first end portion of the first guide 225 is formed in a lower position with respect to the aperture. The first guide 225 is formed to extend from the first end portion frontward toward the boundary part B2 and extend further to incline lower-frontward to a second end portion, which is formed in a position approximate to the front face of the main body 110. Although not shown in the drawings, a second guide is a guiding groove formed on the inner surface 312C of the exterior cover 320. The second guide is formed in a lower position with respect to the second end portion of the first guide 225. The second guide is in a lower position with respect to the second end portion of the first guide 225 and extends downward.

As shown in FIGS. 7 and 14-16, the bottom block 127D is formed to have a pair of ports 127H, which vertically penetrate the bottom block 127D, and one of which is on a right-hand side and the other of which is on a left-hand side respectively. The port 127H on the right is formed in a lower position with respect to the operation panel 130 and an upper position with respect to the upper surface 111U of the attachment section 111 on the right. As shown in FIGS. 7 and 16, the port 127H on the right partly coincides with the groove 210 on the right vertically. The port 127H on the left is not shown but is formed similarly to the port 127H on the right. The port 127H on the left is formed in a lower position with respect to the operation panel 130 and an upper position with respect to the upper surface 112U of the attachment section 112 on the left. The port 127H on the left partly coincides with the groove 220 on the left vertically.

Effects

According to the image forming apparatus 1 in the present embodiment, when liquid such as water is poured over the operation panel 130 of the upper unit 120, as shown in an arrow F1 in FIG. 16, the liquid may flow on the inclined surface of the operation panel 130 and enter the gaps S1, S2 formed in the position between the upper surfaces 111U, 112U of the attachment sections 111, 112 and the lower surfaces 121D, 122D of the attachable sections 121, 122 through the boundary parts B1, B2 (see also FIG. 4). In this regard, however, in the positions on the upper surfaces 111U, 112U of the attachment sections 111, 112 adjacent to the boundary parts B1, B2, the grooves 210, 220 are formed to dent downward and stretch in parallel with the widthwise direction, along which the boundary parts B1, B2 stretch. Therefore, the liquid entering the gaps S1, S2 through the boundary parts B1, B2 is directed to the grooves 210, 220, as indicated by the arrow F1 in FIG. 16, and is reserved securely in the grooves 210, 220.

As shown in FIGS. 5 and 12, the bottoms 210P, 220P of the grooves 210, 220 incline to be lower toward the pickup area 30. In this regard, the grooves 210, 220 are in communication with the pickup area 30 through the first ends 221, 221, which are on the side of the pickup area 30. Therefore, as indicated by an arrow F2 shown in FIG. 12, the liquid entering the gaps S1, S2 through the boundary parts B1, B2 is guided on the bottoms 210P, 220P to the pickup area 30 and drained to the pickup area 30 through the first ends 211, 221.

As shown in FIGS. 5-12, the first wall 213 formed on the second end 212 of the groove 210 on the right protrudes upward to plugs the gap between the exterior cover 310 and the groove 210. Therefore, even when the liquid entering through the boundary parts B1, B2 tends to flow through the grooves 210, 220 toward the exterior covers 310, 320, at least a part of the liquid may be blocked by the first walls 213, 223.

Thus, in the image forming apparatus 1 according to the embodiment, the liquid pouring over the upper unit 120 and flowing through the boundary parts B1, B2 and the gaps S1, S2 may be prevented from entering inside the main body 110 through, for example, the gap S3 (see FIGS. 6, 7) and the link housings 111R, 112R (see FIGS. 3, 5).

Further, in the image forming apparatus 1 according to the embodiment, as shown in FIGS. 3 and 4, the control board 10C and the driving motor 10M in the image forming unit 10 are placed in the main body 110 in the positions adjacent to the inner surfaces 310C, 320C of the exterior covers 310, 320 respectively and in the positions opposite from the boundary parts B1, B2 across the grooves 210, 220 along the specific direction D1, in which the user may face the stackable surface 113 from the front side of the image forming apparatus 1. Meanwhile, as shown in FIGS. 6, 7, and 12, the aperture-peripheral part 319 in the exterior cover 310 on the right forms the aperture 319H, which adjoins the second end 212 of the groove 210 and provides the vertically penetrating gap between the aperture-peripheral part 319 and the outer wall surface 111E. As indicated by the arrow F3 shown in FIG. 12, the liquid flowing through the second end 212 of the groove 210 toward the exterior cover 310 flows downward. Further, although not shown in the drawings, through the aperture formed in the position between the aperture-peripheral part in the exterior cover 320 on the left and the outer wall surface 112E, the liquid flowing through the second end 222 of the groove 220 toward the exterior cover 320 flows downward.

As indicated by the arrow F4 shown in FIG. 11, the first guide 215 formed on the outer wall surface 111E of the attachment section 111 receives the liquid flowing through the aperture 319H by the first end portion 215B thereof, which is formed at the lower position with respect to the aperture 319H. Meanwhile, the second end portion 215A is formed on the front side, and the liquid may be guided toward the boundary part B1, i.e., in a direction to be apart from the control board 10C, while the control board 10C is arranged in the position to adjoin the inner surface 310C of the exterior cover 310 and closer to the ejection opening 39 than the first guide 215. Although not shown in the drawings, the first guide 225 formed on the outer wall surface 112E of the attachment section 112 receives the liquid flowing through the aperture by the first end portion thereof, which is formed at the lower position with respect to the aperture, and while the second end portion is formed on the front side, the liquid may be guided toward the boundary part B2, i.e., in a direction to be apart from the driving motor 10M, while the driving motor 10M is arranged in the position to adjoin the inner surface 320C of the exterior cover 320 and closer to the ejection opening 39 than the first guide 225.

As indicated by the arrow F4 in FIG. 11 and an arrow F5 in FIG. 13, the second guide 316 formed on the inner surface 310C of the exterior cover 310 to extend downward receives the liquid guided by the first guide 215 at the lower position with respect to the second end portion 215A of the first guide 215, which is a part of the first guide 215 farthest from the control board 10C along the specific direction, and drains the liquid downward. Although not shown in the drawings, the second guide formed on the inner surface 320C of the exterior cover 320 to extend downward receives the liquid guided by the first guide 225 at the lower position with respect to the other end portion of the first guide 225, which is a part of the first guide 225 farthest from the driving motor 10M along the specific direction, and drains the liquid downward.

As indicated by an arrow F3 in FIG. 12, the second wall 313 protruding from the inner wall 310C of the exterior cover 310 in the dent 111F formed on the outer wall surface 111E of the attachment section 111 drains the liquid flowing through the aperture 319H leftward. Thereby, the liquid is separated away from the inner wall 310C of the exterior cover 310 and securely reaches the first end portion 215B of the first guide 215. Although not shown in the drawings, the second wall formed on the inner wall 320C of the exterior cover 320 drains the liquid flowing through the aperture rightward. Thereby, the liquid is separated away from the inner wall 320C of the exterior cover 320 and securely reaches the end portion 225B of the first guide 215.

Thus, the image forming apparatus 1 may restrain the liquid flowing through the aperture 319H on the right and the other aperture (not shown) on the left from spreading on the inner walls 310C, 320. Accordingly, the liquid may be restrained from reaching the control board 10C and the driving motor 10M, which are arranged in the positions adjacent to the inner walls 310C, 320C of the exterior cover 310, 320 respectively. Therefore, the control board 10C and the driving motor 10M may be prevented from being exposed to the liquid; and short circuit which might otherwise be caused by the liquid may be prevented.

Thus, in the image forming apparatus 1 with the boundary parts B1, B2 between the joint cover 117 and the upper unit 120, damage in the image forming unit 10 in the main body 110, which might otherwise be caused by the liquid pouring over the upper unit 120, may be securely prevented.

Further, in the image forming apparatus 1, when the liquid flows inside the upper unit 120 through the gap S4 formed between the lower end 135 of the operation panel 130 and the front end 125 of the bottom block 127D, the liquid may be guided to the upper surfaces 111U, 112U of the attachment sections 111, 112 through the pair of ports 127H formed in the bottom block 127D and drained out of the upper unit 120. In particular, the ports 127H partly overlap the grooves 210, 220 along the vertical direction respectively; therefore, the liquid flowing through the ports 127H may flow in the groove 210, 220 and may be drained to the pickup area 30 securely. Accordingly, damage to the touch-sensitive panel 131 and the reader unit 20 accommodated in the upper unit 120 may be prevented.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the upper unit 120 may not necessarily be openable/closable with respect to the main body 110 but may be fixed to the main body 110.

For another example, the paired attachment sections 111, 112 may not necessarily be arranged to adjoin the widthwise sides of the stackable surface 113 but may be arranged to adjoin two adjoining sides of the rectangular stackable surface which are continuous in a form of an "L."

For another example, the grooves 210, 220 may not necessarily be formed to extend in parallel with the boundary parts B1, B2 but may be formed to extend in directions to intersect with the boundary parts B1, B2.

For another example, the grooves 210, 220 may not necessarily be formed to guide the liquid on the bottoms 210P, 220P to the pickup area 30 but may be formed to guide the liquid toward the exterior covers 310, 320.

For another example, the first guides 215, 225 and the second guides 316 (one of the second guides on the left is not shown) may not necessarily be formed on the outer wall surfaces 111E, 112E of the attachment sections 111, 112 and the inner surfaces 310C, 320C of the exterior cover 310, 320 respectively but the positions of those may be reversed. That is, the first guides 215, 225 may be formed on the inner surfaces 310C, 320C of the exterior cover 310, 320, and the second guides 316 may be formed on the outer wall surfaces 111E, 112E of the attachment sections 111, 112.

For another example, the embodiment described above may not necessarily be applied to a image forming apparatus but may be employed in, for example, a copier, or a multifunction peripheral device.

What is claimed is:

1. An image forming apparatus, comprising:

a main body;

a cover configured to cover an upper part of the main body; and an upper unit arranged in an upper position with respect to the cover, wherein the cover comprises a stackable surface, on which a sheet having the image formed thereon by an image forming unit and being ejected out of the main body is placed, and an attachment section formed to extend upward from the stackable surface and to have an inner wall surface, on an upper side thereof, the inner wall surface of the attachment section adjoining the stackable surface and rising upward from the stackable surface, wherein the upper unit comprises a base surface and an attachable section on a bottom plane thereof, the base surface being arranged to spread over the stackable surface with a predetermined amount of a gap reserved between the base surface and the stackable surface, and the attachable section being arranged in a position to adjoin the base surface to face a top surface of the attachment section and being configured to be attached to the attachment section, wherein the attachment section is formed to have a downward dent on the top surface thereof, the downward dent being positioned to adjoin a boundary part, the boundary part being a part of a gap formed in a position between the top surface of the attachment section and a bottom surface of the attachable section, and wherein the downward dent is a groove elongated in parallel with the boundary part.

2. The image forming apparatus according to claim 1, wherein the attachment section comprises a pair of attachment sections, the pair of attachment sections being formed to adjoin the stackable surface at both ends along a widthwise direction, the widthwise direction being orthogonal to a direction to eject the sheet and to a vertical direction, and wherein the attachable section comprises a pair of attachable sections, each of which is attached to respective one of the pair of attachment sections.

3. The image forming apparatus according to claim 1, wherein a bottom of the groove of the attachment section inclines to be lower toward the stackable surface.

4. The image forming apparatus according to claim 3, further comprising:

an exterior cover configured to cover an outer wall surface of the attachment section, the outer wall surface of the attachment section facing an opposite direction from the inner wall surface, wherein one of end portions of the groove of the attachment section arranged on a side of the outer wall surface comprises a first wall protruding upward.

5. The image forming apparatus according to claim 3, further comprising:

an exterior cover configured to cover an outer wall surface of the attachment section, the outer wall surface of the attachment section facing an opposite direction from the inner wall surface, wherein the image forming unit comprises an electric device, the electric device being arranged in the main body in a position to adjoin an inner surface of the exterior cover and on a side opposite from the boundary part along a specific direction across the groove of the attachment section, the specific direction being a direction to eject the sheet from the main body, wherein one of end portions of the groove of the attachment section is arranged on a side of the outer wall surface of the attachment section, and wherein the exterior cover comprises an aperture-peripheral part, the aperture-peripheral part being arranged to adjoin the one of end portions of the groove of the attachment section to form an aperture that penetrates vertically in a position between the outer wall surface of the attachment section and the aperture-peripheral part.

6. The image forming apparatus according to claim 5, wherein a first guide is arranged on one of the outer wall surface of the attachment section and the inner surface of the exterior cover, the first guide comprising a first end portion being arranged in a lower position with respect to the aperture, the first guide being formed to extend from the first end portion toward the boundary part along the specific direction.

7. The image forming apparatus according to claim 6, wherein a second guide is arranged on one of the outer wall surface of the attachment section and the inner surface of the exterior cover, the second guide being arranged to extend downward in a lower position with respect to a second end portion of the first guide, the second end portion of the first guide being an opposite end from the first end portion.

8. The image forming apparatus according to claim 6, wherein the exterior cover comprises a wall in an upper position with respect to the first end portion of the first guide, the wall being formed to protrude from the inner surface of the exterior cover toward the outer wall surface of the attachment section.

9. The image forming apparatus according to claim 1, wherein the upper unit comprises a bottom block forming the bottom plane of the upper unit and a panel arranged in an upper position with respect to the bottom block, the panel forming a part of an upper plane of the upper unit in a position spaced apart farther from the attachment section with respect to the boundary part, wherein the bottom block comprises a port, the port being formed to penetrate the bottom block vertically in an upper position with respect to the top surface of the attachment section.

10. The image forming apparatus according to claim 9, wherein at least a part of the port overlaps the groove of the attachment section vertically.

11. The image forming apparatus according to claim 1, further comprising:

a reader unit configured to read an image on an original sheet, wherein the reader unit is accommodated in the upper unit.

12. The image forming apparatus according to claim 1, further comprising:

an exterior cover configured to cover an outer wall surface of the attachment section, the outer wall surface of the attachment section facing an opposite direction from the inner wall surface; and a first guide arranged on one of the outer wall surface of the attachment section and an inner surface of the exterior cover, the first guide comprising a guiding groove arranged in a lower position with respect to the upper surface of the attachment section.

13. The image forming apparatus according to claim 12, wherein the first guide is arranged on the outer wall surface of the attachment section, wherein the exterior cover comprises a wall in an upper position with respect to the first guide, the wall being formed to protrude from the inner surface of the exterior cover toward the outer wall surface of the attachment section.

14. The image forming apparatus according to claim 12, wherein the first guide is arranged on the inner surface of the exterior cover, wherein the outer wall surface of the attachment section comprises a wall in an upper position with respect to the first guide, the wall being formed to protrude from the outer wall surface of the attachment section toward the inner surface of the exterior cover.

15. The image forming apparatus according to claim 12, wherein the guiding groove of the first guide extends toward a specific direction being a direction to eject the sheet from the main body.

16. The image forming apparatus according to claim 15, further comprising:

an ejection opening, through which the sheet is ejected from the main body, wherein the guiding groove of the first guide inclines with respect to the specific direction to be lower as the first guide extends farther from the ejection opening.

17. The image forming apparatus according to claim 15, further comprising:

an electric device being arranged in the main body in a position to adjoin an inner surface of the exterior cover and closer to the ejection opening than the guiding groove of the first guide along the specific direction.

18. The image forming apparatus according to claim 16, wherein a second guide is arranged on one of the outer wall surface of the attachment section and the inner surface of the exterior cover, the second guide being arranged to extend downward in a lower position with respect to a part of the first guide which is farthest from an electric device along the specific direction.

* * * * *